US010652986B1

(12) United States Patent
Romano

(10) Patent No.: US 10,652,986 B1
(45) Date of Patent: May 12, 2020

(54) DIMMER SYSTEM CONTROL

(71) Applicant: Shafrir Romano, Rishon Lezion (IL)

(72) Inventor: Shafrir Romano, Rishon Lezion (IL)

( * ) Notice: Subject to any disclaimer, the term of this patent is extended or adjusted under 35 U.S.C. 154(b) by 0 days.

(21) Appl. No.: 16/398,740

(22) Filed: Apr. 30, 2019

(51) Int. Cl.
*H05B 47/19* (2020.01)
*H05B 45/10* (2020.01)
*H05B 45/20* (2020.01)

(52) U.S. Cl.
CPC ..... *H05B 47/19* (2020.01); *H05B 45/10* (2020.01); *H05B 45/20* (2020.01)

(58) Field of Classification Search
CPC ..... H05B 37/0272; H05B 33/0845; H05B 33/0857
USPC ..... 315/152
See application file for complete search history.

(56) References Cited

U.S. PATENT DOCUMENTS

2008/0111491 A1 5/2008 Spira
2014/0035482 A1* 2/2014 Rains, Jr. ..... H05B 37/0254 315/294
2015/0137699 A1 5/2015 Killo et al.

* cited by examiner

*Primary Examiner* — Daniel D Chang
(74) *Attorney, Agent, or Firm* — Emerson, Thomson & Bennett, LLC; Roger D. Emerson

(57) ABSTRACT

A method and system for allowing automatic provisioning of a LED lamp in a dimmer system. The dimmer powers the lamp through a switched AC line. A wireless link serves for information exchange between the dimmer and the lamp. When the lamp is turned on by the dimmer, it starts a short waiting period in which it expects to wirelessly receive from the dimmer a provisioning message including a dimmer identification, which it saves to identify dimming messages the dimmer. Another aspect of the invention is disclosed in the above dimmer system, wherein the lamp comprises a backup battery. The dimmer wirelessly informs the lamp upon voltage drops at its input caused by user OFF actions and/or by AC supply outage. The lamp is configured to assume backup mode only upon detecting, based on the above information, a voltage drop at its input caused by an AC supply outage.

12 Claims, 4 Drawing Sheets

| Line voltage state or transition | UI ON/OFF state or transition | Resulted wireless message | Resulted lamp light |
|---|---|---|---|
| 1 UP | ON → OFF | User OFF ⇑ Alternatives ⇓ AC supply outage | No light |
| 2 Up → Down | ON | | Backup light |
| 3 Up → Down | OFF | | No light |
| 4 Down | OFF → ON | User ON | Backup light |
| 5 Down | ON → OFF | User OFF | No light |
| 6 UP | OFF → ON | | Normal light |
| 7 Down → Up | ON | | Normal light |
| 8 Down → Up | OFF | | No light |

Fig. 4

DIMMER SYSTEM CONTROL

FIELD OF THE INVENTION

The present invention relates generally to lighting systems, and more particularly to methods and systems that involve light dimming.

BACKGROUND OF THE INVENTION

Light Emitting Diodes (LEDs) have become a prevailing technology in the industry of lighting. Alongside the market transition to LED lighting, dimming techniques, as well as techniques for controlling the resultant color of multi-color LED arrays, have become well-established in the art. The implementation of these techniques commonly involve wireless communication, which necessitates some provisioning process for associating between the dimmer and the LED lamp.

Regarding this issue, US Patent Application 20080111491 discloses a wireless lighting control system comprises a dimmer switch and a remote control. The dimmer switch is coupled in series between an AC power source and a lighting load and comprises a first actuator and a wireless receiver. The dimmer switch is operable to control the amount of power delivered to the lighting load in response to an actuation of the first actuator or a wireless control signal received by the wireless receiver. The remote control comprises a second actuator and a wireless transmitter operable to transmit the wireless control signal is response to an actuation of the second actuator. The remote control is operable to be associated with the dimmer switch in response to simultaneous actuations of the first and second actuators. Accordingly, the dimmer switch subsequently controls the intensity of the lighting load in response to the wireless control signal transmitted by the remote control. However, the disclosed association technique is not applicable when the LED lamp is already ceiling mounted, which hinders the actuation operation.

US Patent Application 20150137699 discloses a method for associating a first wireless control device with a second wireless control device, the method comprising: receiving, at the second wireless control device, wireless signals from the first wireless control device; measuring a signal strength of each of the wireless signals received by the second wireless control device; determining whether a change has occurred in the signal strength of the wireless signals received by the second wireless control device; and associating the first wireless control device and the second wireless control device when the signal strength of the wireless signals received by the second wireless control device has changed. However, the disclosed association technique is not applicable when both the dimmer and the lamp are stationary.

Another association technique known in the art involves clicking in the controller, or dimmer, the lamp's serial number. However this technique necessitates knowing the lamp's serial number and is not applicable in the case of a dimmer with a simple user interface.

Thus, it would be desirable to provide an automatic method for associating a lamp, typically though not necessarily a dimmable LED lamp, with a typically wall mounted device that serves as an ON/OFF switch as well as wireless based dimmer. Also needed in the art is an advance method to allow better user control of the latter system when it assumes a backup mode of operation in the case of AC line voltage outage.

SUMMARY OF THE INVENTION

Accordingly, it is a principal object of the present invention to provide a method of automatic association between a dimmer and a dimmable lamp controlled thereby. In typical embodiments, the dimmer is wall mounted and allows users to turn ON/Off and wirelessly control the intensity, and optionally the color, of the light emitted from the lamp. The lamp typically includes one or more LED arrays and is mounted remotely from the dimmer.

Thus, in accordance with an embodiment of the present invention, the disclosed method comprises the following steps: Turning ON the lamp by providing thereto AC line voltage from the dimmer. Upon turning ON, waiting at the lamp for a dimmer provisioning message during a predetermined waiting for provisioning period. Wirelessly transmitting from the dimmer a dimmer provisioning message comprising a unique dimmer identification (ID). The method ends with the step of saving the dimmer ID in the lamp upon receiving a dimmer provisioning message during the waiting for provisioning period. This allows the lamp to interpret in the future only messages transmitted thereto from the associated dimmer.

In some embodiments, the provisioning method further comprises the following steps: Checking whether the dimmer ID received in the lamp is a new one. In such a case, conditioning its saving in the lamp on occurring the preceding steps with the new dimmer ID a predetermined number of times during a predetermined time window.

In some embodiments, the provisioning method further comprises the following steps: Wirelessly transmitting from the lamp a lamp provisioning message comprising a unique lamp ID. Upon its receipt in the dimmer, saving the unique lamp ID therein for future communication with the lamp. In some of these embodiments, transmitting the lamp provisioning message is delayed by a safety delay comprising a random component so as to avoid collision in a system that comprises more than one lamp.

In accordance with an embodiment of the present invention, there is also provided a dimmer system comprising a dimmable lamp, a dimmer and a switched AC line wire connection therebetween. The lamp comprises a wireless adapter. The dimmer comprises a user operable AC line switch for turning ON/OFF and powering the lamp through the wire connection, and a wireless adapter for exchanging provisioning and dimming messages with the lamp. The dimmer is configured, after turning ON the lamp, to wirelessly transmit a dimmer provisioning message comprising a unique dimmer identification (ID), and the lamp is configured as follows: Upon turning ON, to wait for the provisioning message during a predetermined waiting for provisioning period, and on receiving a dimmer provisioning message during the waiting for provisioning period, to save the dimmer ID so as to identify thereby future messages transmitted thereto from the dimmer.

Another aspect of the present invention is expressed in an embodiment of the above dimmer system that has the following properties: The lamp comprises a backup energy source for powering the lamp in a backup mode of operation. The dimmer is configured to wirelessly inform the lamp, in at least one of the following ways, on AC voltage drops on the switched AC line connection therebetween: (a) Informing upon each user initiated voltage drop, and (b) informing upon each voltage drop caused by an AC line voltage drop due to an AC voltage supply outage at its AC line input port. The lamp is configured to assume the backup mode only upon detecting, based on the above information, a voltage drop on the switched AC line caused by a voltage outage at the dimer's AC line input port.

BRIEF DESCRIPTION OF THE DRAWINGS

The present invention will be more fully understood from the following detailed description of the embodiments thereof, taken together with the drawings in which:

FIG. 4 is an event related table, that schematically illustrates the operation of a dimmer system comprising a combined dimmable and backup-lighting lamp, in accordance with another aspect implemented in embodiments of the present invention.

DETAILED DESCRIPTION OF EMBODIMENTS

Embodiments of the present invention provide dimmer based lighting systems that employ an automatic provisioning method. This means that there is no need for a user involved association process between the dimmer and the one or more dimmable lamps that it feeds and controls. The association is achieved by means of a provisioning protocol that runs when the user turns on the lamp, or lamps. In a typical embodiment, a wall mounted dimmer is wire connected to a ceiling or wall mounted dimmable lamp. The following description relates to LED based lighting systems, however the disclosed techniques may be applied to other lighting technologies as well.

Figure 1:
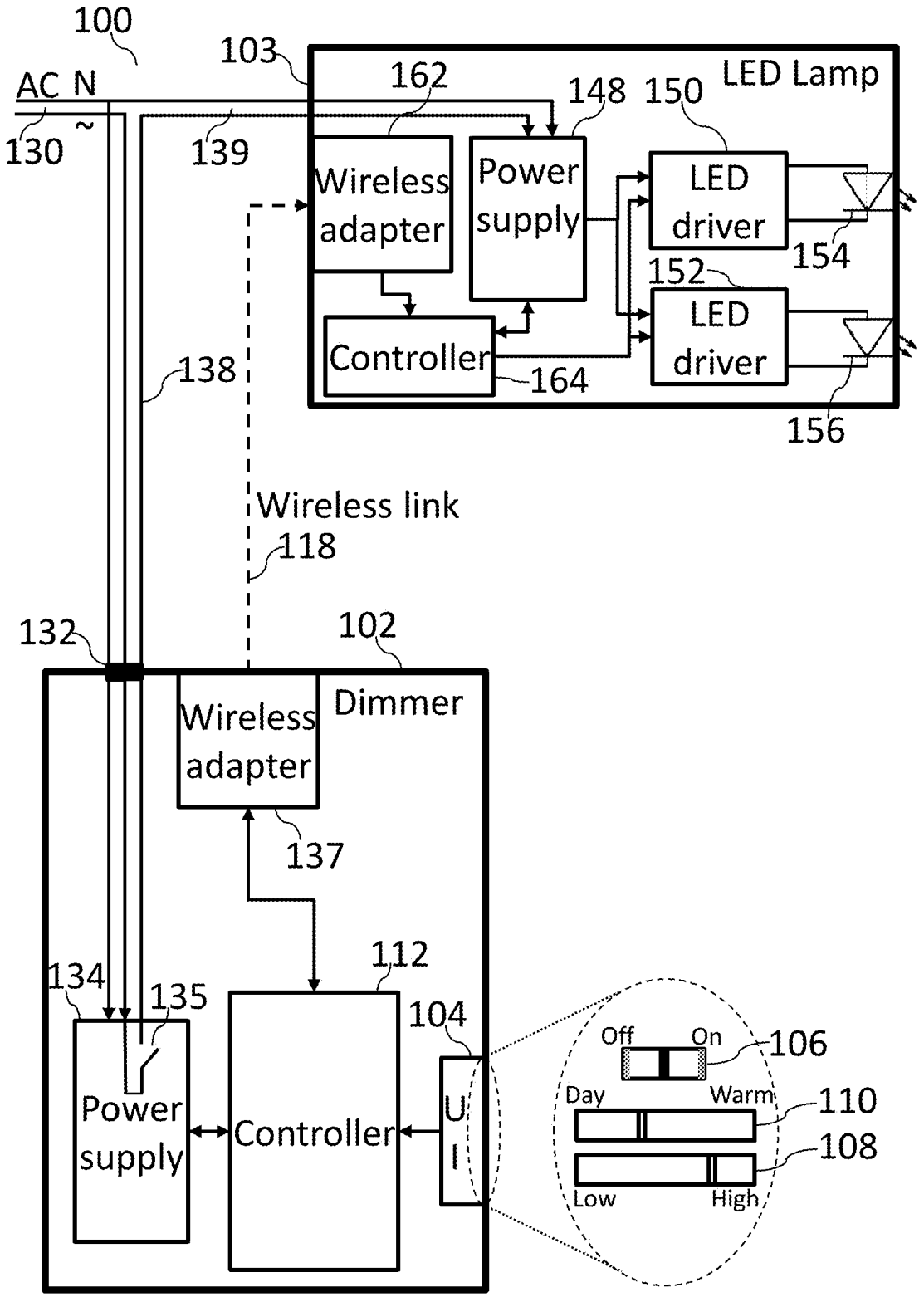
FIG. 1 is a block diagram that schematically illustrates a dimmer system, in accordance with an embodiment of the present invention.

Referring to FIG. 1, there is shown a block diagram of a lighting system 100, in accordance with an embodiment of the present invention. In the figure, a dimmer 102 is connected to a dimmable LED lamp 103 as explained below. Dimmer 102 comprises a User interface (UI) 104 comprising sliders 108 and 110 for continuous respective adjustments of the intensity and the color temperature of the light emitted from lamp 103. UI 104 also includes an OFF/ON selector or push button 106 for switching an AC line going to lamp 103 as explained below. In some embodiments user ON/OFF control 106 may also be embedded in slider 108. In some embodiments, UI 104 includes only light intensity and ON/OFF user controls, or only ON/OFF control for backup lighting mode control as will be described hereinafter. UI 104 transfers electric signals, which reflect the user's select action, to a controller 112.

Controller 112 reads from UI 104 the ON/OFF, intensity and color temperature values chosen by the user and generates therefrom control messages transferred to lamp 103 through a wireless adapter 137. The wireless communication between dimmer 102 and lamp 103 is illustrated in FIG. 1 as a wireless link 118. Controller 112 also transfers the ON/OFF user control from UI 104 to a power supply (PS) 134 to affect an AC line ON/OFF switch 135 attached to PS 134. In some embodiments the user ON/OFF action affects switch 135 through a direct connection between UI 104 and PS 134. When user control 106 is in ON position, switch 135 is closed and Dimmer 102 is deemed to be in ON state. PS 134 is fed by an AC supply line 130 through a wire connection 138 and an AC line input port 132. Port 132 also constitutes a switched AC line output port that leads switched AC line voltage to lamp 103 through wire connection 138. Lamp 103 is fed through a switched wire connection 139, in which at least the phase line is switched by switch 135 and passes through port 132 and wire connection 138.

Lamp 103 comprises a PS 148 that is fed through wire connection 139 as explained above. PS 148 powers two LED drivers 150 and 152 that drive respective two closely spaced LED arrays 154 and 156 each having a different color temperature. The driving power and consequently the intensity of light emitted from each LED array is determined by a controller 164 that controls LED drivers 150 and 152 based on dimming messages that it receives from controller 112 through a wireless adapter 162. In some embodiments lamp 103 includes only one LED array and driver, while in other embodiments it includes more than two thereof.

The wireless communication between wireless adapters 137 and 162 may pass through a mediation station not shown in FIG. 1. In embodiments of the present invention, the employed wireless technology may be of various types and communication protocols such as Bluetooth, ZigBee, Wi-Fi and any proprietary type and protocol. In some embodiments system 100 comprises additional dimmable lamps such as 103, not shown in FIG. 1, which are also fed through switched AC line 139 and controlled through wireless link 118. In one embodiment any of controllers 112 and 164 comprises a general purpose processor which runs software for carrying out the functions described above. However, any other suitable control means can be used alternatively or additively such as ASICs and FPGAs.

The above description has focused on the specific elements of lighting system 100 that are essential for understanding certain features of the disclosed techniques. Conventional elements and connectivity that are not needed for this understanding have been omitted from FIG. 1 for the sake of simplicity, but will be apparent to persons of ordinary skill in the art. The configuration shown in FIG. 1 is an example configuration, which was chosen purely for the sake of conceptual clarity. In alternative embodiments, any other suitable configurations can also be used.

Figure 2:
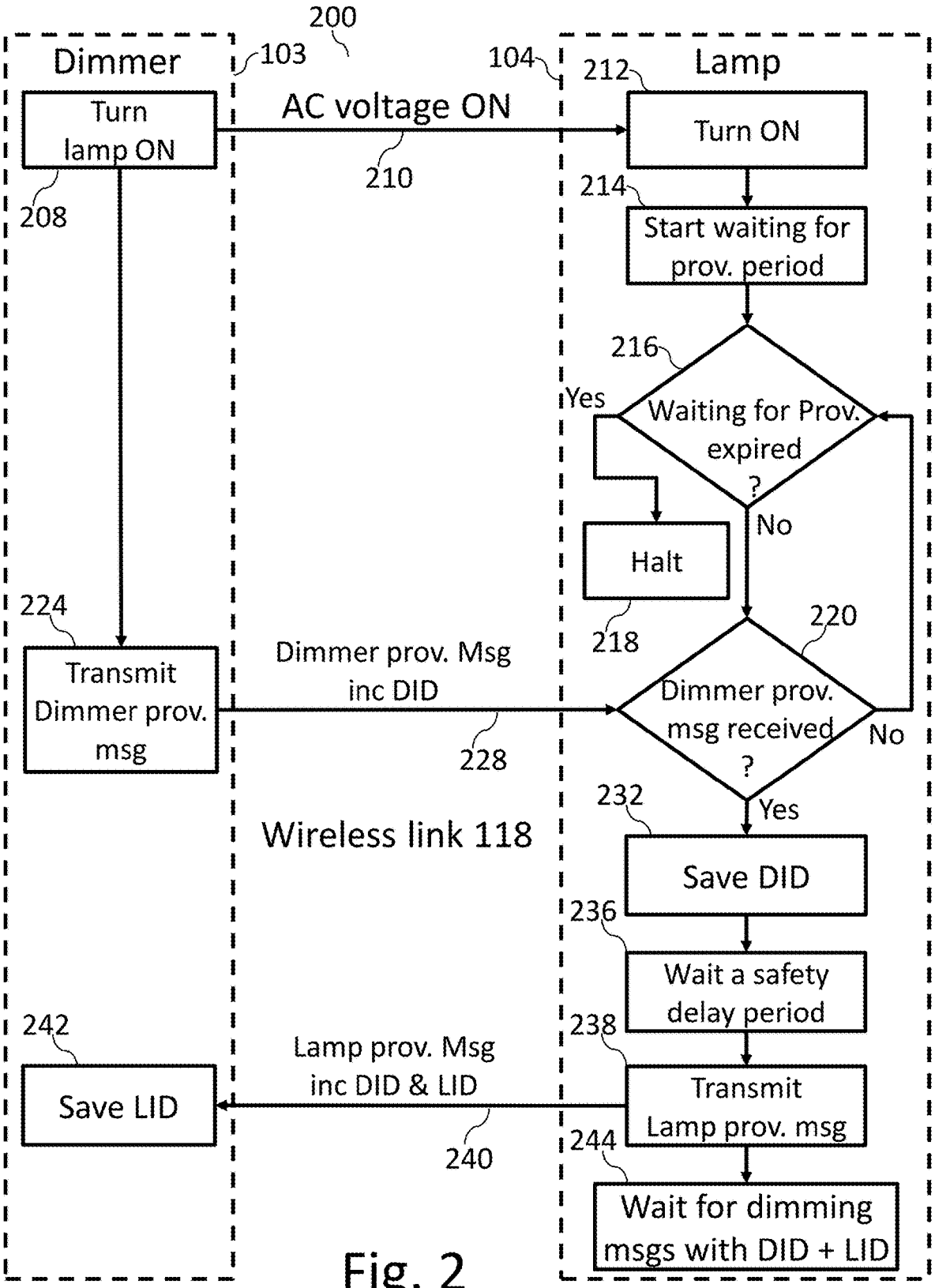
FIG. 2 is a flowchart that schematically illustrates a method of automatic lamp provisioning in a dimmer system, in accordance with an embodiment of the present invention.

Referring now to FIG. 2, there is shown a flowchart 200 which schematically illustrates a method of automatic lamp provisioning in a dimmer system such as system 100, in accordance with an embodiment of the present invention. The method steps are illustratively mapped on their initiating devices in system 100, i.e. dimmer 100 and lamp 103. The drawing also includes messages exchanges between dimmer 100 and lamp 103 through wireless link 118. Flowchart 200 begins with a turning ON step 208, in which, due to user 'turn ON' operation on user control 106, ON/OFF switch 135 provides AC line voltage through AC lines 138 and 139 to PS 148 in lamp 103. This AC transfer, depicted as transfer 210, causes lamp 103 to turn ON in a turning ON step 212.

Controller 164 in lamp 103 then starts a waiting state in a starting step 214, and then, in a waiting step 216, it waits for receiving from dimmer 100 a dimmer provisioning message during a predetermined waiting for provisioning period. This waiting period is determined as short as possible so as to minimize the probability of false provisioning, i.e. association with a foreign dimmer, while still ensuring reliable reception of the dimmer provisioning message from dimmer 100. A waiting period of several tenths of a second is implemented in typical embodiments, however a waiting shorter period may also be employed. In some embodiments a somewhat longer period is employed so as to allow dimmer provisioning message retransmission, which is not illustrated in FIG. 2 since assumed apparent to persons of ordinary skill in the art. If the waiting for provisioning period expires while still waiting, controller 164 turns to a halt state in a halting step 218, in which it stops listening to wireless communication coming through wireless link 118.

Flowchart 200 proceeds to a transmitting step 224 in dimmer 102. Here, after turning ON lamp 103, controller 112 transfers to controller 164 a dimmer provisioning message including a unique identification of dimmer 100 (DID). This transfer, through wireless adapter 137, wireless link 118 and wireless adapter 162, is indicated by reference number 228. A decision block 220 is part of the waiting step illustrated by block 216. If controller 164 receives the dimmer provisioning message before the waiting period expiry it proceeds to a saving DID step 232 in which it saves the received DID in a built-in nonvolatile memory. In some embodiments, controller 164 is capable of saving several DIDs to allow being controlled by more than one dimmer (which is not shown in FIG. 1). Next, in a waiting step 236, controller 164 waits a safety delay period comprising a random component so as to avoid collision in a system that comprises more than one lamp. After the delay, in a transmitting step 238, controller 164 wirelessly transfers to controller 112 a Lamp provisioning message, which includes a unique identification of lamp 103 (LID). This transfer is indicated by a reference number 240 and constitutes an acknowledgement of safe receipt of transfer 228. Then, in a saving step 242, controller 112 saves the received LID in a built-in nonvolatile memory. In some embodiments, controller 112 is capable of saving several LIDs to allow controlling more than one lamp (which is not shown in FIG. 1). Flowchart 200 ends with a waiting step 244, in which controller 164 is waiting for dimming messages coming from dimmer 100 through wireless link 118. These dimming messages will reflect user actions applied through UI 104 and will comprise the above unique DID and LID.

Flowchart 200 is an example flowchart, which was chosen purely for the sake of conceptual clarity. In alternative embodiments, any other suitable flowchart can also be used for illustrating the disclosed method. Method steps that are not mandatory for understanding the disclosed techniques were omitted from FIG. 2 for the sake of simplicity. Following are some additional aspects of the disclosed method that are not shown in FIG. 2 but may be employed in various implementations of the present invention:

Employing LID, as in steps 236 to 242, is optional and typically implemented in embodiments of system 100 that are designed to potentially include multiple lamps powered by dimmer 102. In these embodiments controller 112 is capable of storing several LIDs. In these embodiments also a retry mechanism is typically realized to mitigate possible message collisions in wireless link 118. In one embodiment, the following example procedure is implemented for incorporating a new dimmer and/or a new lamp in a new or in an existing system: The user is instructed, in this case, to repeat turning ON the system, through user control 106, several consecutive times during typically a few seconds. Controller 112 repeats step 224 correspondingly. Controller 164 is configured to condition saving a new DID, whether this is the first one or an additional one, on receiving it a predetermined number of times, each time as in step 220, during a predetermined time window of, typically, a few seconds. In some other embodiments, a variation of flowchart 200 is implemented in which transfer 240 precedes transfer 228.

Figure 3:
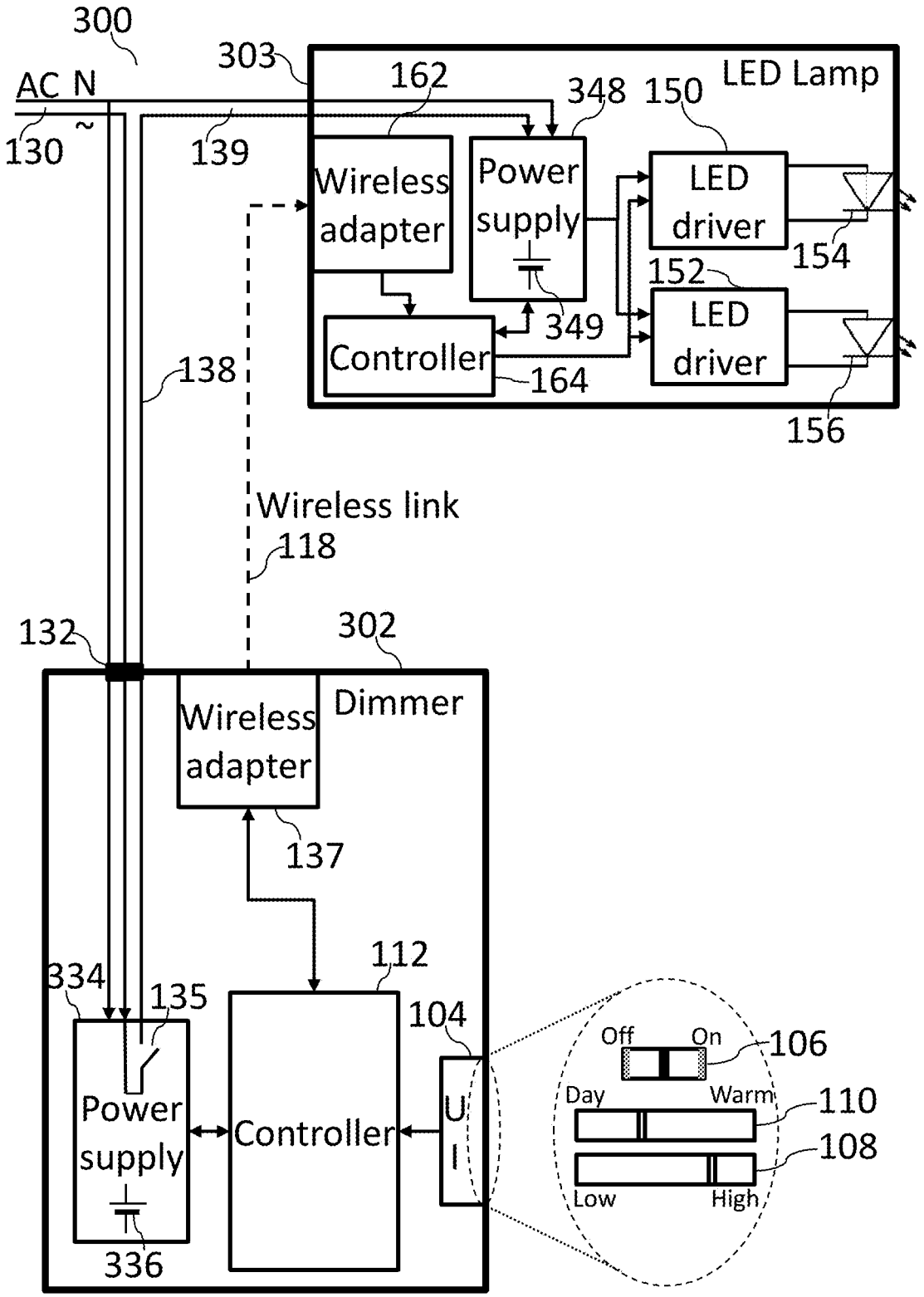
FIG. 3 is a block diagram that schematically illustrates a dimmer system comprising a combined dimmable and backup-lighting lamp, in accordance with an embodiment of the present invention.

FIG. 3 is a block diagram that schematically illustrates a dimmer system 300 comprising a dimmer 302 and a combined dimmable and backup-lighting lamp 303, in accordance with an embodiment of the present invention. System 300 is similar in structure to system 100, as well as its dimming related behavior. However, dimmer 301 in system 300 comprises a PS 334 comprising an energy source 336 whose function will be explained hereinafter. A second difference is that in system 300 a lamp 303 comprises a PS 348 comprising a backup battery 349. Battery 349 is used to power lamp 348 for emitting light in a backup mode of operation when controller 164 applies it. In embodiments of system 300, controllers 112 and 164 are configured to start and maintain the backup mode when there is an AC supply outage on line 130 and dimmer 302 is in ON state. This is achieved, as explained below, though lamp 303 cannot be aware of the dimmer state through two-wire AC line 139. In typical embodiments, normal dimming operation is allowed in backup mode. This is performed as in normal operation: controllers 112 converts the user selection on UI 104 to dimming related information embedded in messages that it sends to controller 164 through wireless link 118. The user selection may comprise light color adjustment in addition or instead of light intensity. In some of these embodiments, controller 112 and/or controller 164 limit the maximum light intensity that lamp 303 may emits in backup mode to a predetermined intensity level, which can be lower than the intensity level selected by the user through UI 104.

FIG. 4 is an event related table, that schematically illustrates the operation of dimmer system 300. The two left columns in the table include eight possible combinations of either state or transition on each of switched AC line output port 132 and user ON/OFF control 106. The two right columns include the respective resulting messages that dimmer controller 112 wirelessly transmits to lamp controller 164, as well as the resulting light that is emitted from lamp 303 as controlled by controller 164.

The first two rows in the table illustrate two options, implemented in respective two alternative embodiments, that are aimed to achieve the following goal: cause controller 164 to apply backup mode of operation only upon detecting, based on the wirelessly received messages, that a voltage drop on switched wire connection 139 is a result of a voltage outage on AC supply line 130 rather than user initiated OFF state of dimmer 302. In the alternative depicted in row 1, controller 112 initiates a "User OFF" message upon each voltage drop at output port 132 initiated by user OFF action. In the alternative depicted in row 2, controller 112 initiates an "AC supply outage" message upon each voltage drop at output port 132 caused by an AC supply outage. Transmitting the latter message necessitates using energy source 336 for a short time after the outage start. In one embodiment a capacitor is employed as energy source 136. In other embodiment a battery is employed, especially for realizing table rows 4 and 5 which are explained below.

In embodiments wherein row 1 is implemented, controller 164 switches PS 148 to backup mode for activating LED drivers 150 and 152 only when the AC voltage on line 139 drops and this drop is not followed by a "User OFF" message. This case is illustrated in row 3. In embodiments wherein row 2 is implemented, controller 164 switches PS 148 to backup mode for activating the drivers only when the AC voltage on line 139 drops and an "AC supply outage"

message follows this drop. In some embodiments, both the messages of the first two rows are employed. Lamp 303 resumes normal operation mode and normal lighting when the AC voltage on line 139 resumes due to AC supply recovery as illustrated in row 7.

Rows 4 and 5 illustrate two complementary cases that are implemented in some embodiments. Both cases relate to an AC voltage supply outage period on AC supply line 130. In row 4, the user turns dimmer 302 to ON state, though this shall not necessarily affect switch 135 in the absence of AC voltage supply. Consequently, controller 112 informs controller 164 about this event by wirelessly sending it a "User ON" message. In response controller 164 causes lamp 303 to operate in backup mode, i.e. to light using battery 349 as an energy source to drivers 150 and 152 through PS 148. When system 300 is in the latter state, and the user turns dimmer 302 to OFF state, controller 112 informs controller 164 about this event by wirelessly sending it a "User OFF" message. In response, controller 164 stops drivers 150 and 152 operation. Rows 6, 7 and 8 relate to conventional operation of backup lighting systems, therefor do not need special explanations.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art.

What is claimed is:

1. A method of automatic lamp provisioning in a dimmer system, wherein the dimmer system comprises a dimmable lamp, a dimmer for powering and controlling the lamp and a wireless link for exchanging provisioning and dimming messages between the dimmer and the lamp, the method comprising the steps of:

turning ON the lamp by providing AC line voltage thereto from the dimmer;

upon turning ON, waiting at the lamp for a dimmer provisioning message during a substantially short predetermined waiting for provisioning period;

wirelessly transmitting, from the dimmer, a dimmer provisioning message comprising a unique dimmer identification (ID); and upon receiving the dimmer provisioning message at the lamp during the waiting for provisioning period, saving the dimmer ID therein so as to thereby identify future messages transmitted thereto from the dimmer.

2. The method of claim 1, further comprising the steps of:

checking, in the lamp, whether the received dimmer ID is a new dimmer ID; and in the case of a new dimmer ID, conditioning its saving in the lamp on occurring the preceding steps with the new dimmer ID a predetermined number of times during a predetermined time window.

3. The method of claim 1, further comprising the steps of:

wirelessly transmitting from the lamp a lamp provisioning message comprising a unique lamp ID; and saving said lamp ID in the dimmer for future communication with the lamp.

4. The method of claim 3, while transmitting the lamp provisioning message after a safety delay comprising a random component, so as to avoid collision in a lighting system that comprises more than one lamp.

5. A dimmer system comprising:

a dimmable lamp comprising a wireless adapter; and a dimmer comprising a user operable AC line switch for turning ON/OFF and powering the lamp through a wire connection, and a wireless adapter for exchanging provisioning and dimming messages with the lamp, wherein the dimmer is configured, after turning ON the lamp, to wirelessly transmit a dimmer provisioning message comprising a unique dimmer identification (ID), and the lamp is configured as follows:

upon turning ON, to wait for the dimmer provisioning message during a substantially short predetermined waiting for provisioning period, and upon receiving the dimmer provisioning message during the waiting for provisioning period, to save the dimmer ID so as to identify thereby future messages transmitted thereto from the dimmer.

6. The dimmer system of claim 5, wherein the lamp is further configured to check whether the received dimmer ID is a new dimmer ID and, in the case of a new dimmer ID, to condition its saving on receiving it a predetermined number of times during a predetermined time window, each time during the predetermined waiting for provisioning period after turning ON.

7. The dimmer system of claim 5, wherein the lamp is further configured to wirelessly transmit a lamp provisioning message comprising a unique lamp ID, and the dimmer is further configured to save said lamp ID for future communication with the lamp.

8. The dimmer system of claim 7, wherein the lamp is configured to transmit the lamp provisioning message after a safety delay comprising a random component so as to avoid collision in a system that comprises more than one lamp.

9. A dimmer system comprising:

a dimmable lamp comprising a wireless adapter and a backup energy source for powering the lamp in a backup mode of operation; and a dimmer comprising an AC line input port, a user interface operationally coupled to activate an AC line ON/OFF switch for respectively providing/dropping the AC line voltage at a dimmer switched AC line output port, and a wireless adapter for sending dimming and ON/OFF information to the lamp, wherein said switched AC line output port is wire connected for powering the lamp, and the dimmer is configured to wirelessly inform the lamp, in at least one of the following two ways, on AC voltage drops at the dimmer switched AC line output port;

(a) informing upon each user initiated voltage drop, and (b) informing upon each voltage drop caused by a voltage outage at the AC line input port, and the lamp is configured to assume the backup mode of operation only upon detecting, based on the wirelessly received information, a voltage drop at the dimmer switched AC line output port caused by a voltage outage at the AC line input port.

10. The dimmer system of claim 9, wherein the dimmer is further configured to wirelessly inform the lamp on user ON/OFF and dimming actions during a voltage outage at the AC line input port so as to cause the lamp to light correspondingly in the backup mode.

11. The dimmer system of claim 9, further configured to limit the light intensity in the backup mode to a predetermined intensity.

12. The dimmer system of claim 9, wherein the lamp comprises a LED base light source and is configured to affect the light emitted therefrom according to the dimming information by varying at least one of the intensity and the color properties of the emitted light.

* * * * *